US005266759A

United States Patent [19]

Dohnal et al.

[11] Patent Number: 5,266,759

[45] Date of Patent: Nov. 30, 1993

[54] ACTUATOR FOR A STEP-TRANSFORMER LOAD SWITCH

[75] Inventors: Dieter Dohnal, Lappersdorf; Josef Neumeyer, Waldetzenberg, both of Fed. Rep. of Germany

[73] Assignee: Maschinenfabrik Reinhausen GmbH, Regensburg, Fed. Rep. of Germany

[21] Appl. No.: 925,979

[22] Filed: Aug. 5, 1992

[30] Foreign Application Priority Data

Aug. 14, 1991 [DE] Fed. Rep. of Germany ..... 4126824

[51] Int. Cl.[5] ..... H01H 33/50

[52] U.S. Cl. ..... 200/144 B; 200/144 R

[58] Field of Search ..... 200/144 R, 144 B, 17 R, 200/18, 50 R, 337

[56] References Cited

U.S. PATENT DOCUMENTS 1,813,996 7/1931 Hill ..... 200/144 B

FOREIGN PATENT DOCUMENTS 2021575 5/1973 Fed. Rep. of Germany .
2002054 8/1973 Fed. Rep. of Germany .
2806282 4/1980 Fed. Rep. of Germany .
3919596 8/1991 Fed. Rep. of Germany .
4011019 12/1991 Fed. Rep. of Germany .

OTHER PUBLICATIONS

MR Reinhausen Manufacturing (Box 96, Alamo Tenn.) Brochure (RM03/90-1090/3009) "Load Tap Changer Type RMV-1".

*Primary Examiner*—Marc S. Hoff

*Assistant Examiner*—Michael A. Friedhofer

*Attorney, Agent, or Firm*—Herbert Dubno; Andrew Wilford

[57] ABSTRACT

An actuator used with a load switch having a rotary drive shaft extending along a drive axis and carrying a cam and with an interrupter having an operating rod displaceable longitudinally of itself and generally perpendicular to the drive axis has a frame defining upper and lower pivots having respective upper and lower axes spaced from each other and generally parallel to the drive axis. An output parallelogrammatic linkage has an output link having upper and lower ends, movable between an upper and a lower position, and formed with an aperture alignable axially with the input-link aperture and an output coupling formation connected longitudinally on the rod so that on movement between the upper and lower positions the interrupter is operated. An input parallelogrammatic linkage has an input link formed with an aperture and an input coupling formation bearing radially on the cam so that rotation of the cam vertically displaces the input link between its upper and lower positions. A spring braced vertically in the windows in a position with the windows aligned axially bears upward on all the upper links and downward on all the lower links. Respective upper and lower stops on the frame engageable with the output link in respective upper and lower positions arrest same therein. Respective upper and lower release formations on the input linkage engage the stops on displacement of the input link into the respective upper and lower positions to release the output link from them.

10 Claims, 3 Drawing Sheets

ACTUATOR FOR A STEP-TRANSFORMER LOAD SWITCH

FIELD OF THE INVENTION

The present invention relates to step-transformer load switch. More particularly this invention concerns an actuator for the vacuum interrupter of such a switch.

BACKGROUND OF THE INVENTION

As described in the MR Reinhausen Manufacturing (Box 96, Alamo Tenn. 38001) brochure (RM03/90-1090/3000) "Load Tap Changer Type RMV-1" it is standard to actuate the vacuum interrupter in a load tap changer with a cam-action linear spring-loaded mechanism that moves the interrupter actuating rod in one direction to close the interrupter and in the opposite direction to open it. Each phase is controlled by one such vacuum interrupter and the actuator has a slide that moves on stationary tie rods. The slide itself is moved on the rods by engagement between a roller it normally carries that rides in a groove in a noncircular cam on the main drive shaft of the load switch.

Since the cam rotates it does not exert force exactly in the linear direction defined by the tie rods carrying the slide. Thus friction is considerable, and jamming is possible.

Various solutions have been proposed, for example in German patent 2,002,054 based on U.S. application Ser. No. 792,349 of D. White, German patent 2,021,575 filed 02 May 1970 by K. Fricke et al, German patent 2,806,282 filed 15 Feb. 1978 by W. Breuer, German patent 3,919,596 based on Japanese applications files 15 Jun. 1988 by S. Ogawa, and German patent 4,011,019 filed 05 Apr. 1990 by D. Dohnal et al. None of these systems constitutes a wholly satisfactory solution to the problem of making the actuator jam- and friction-free.

OBJECTS OF THE INVENTION

It is therefore an object of the present invention to provide an improved actuator for a vacuum-interrupter of a load switch.

Another object is the provision of such an improved actuator for a vacuum-interrupter of a load switch which overcomes the above-given disadvantages, that is which has a particularly simple and fail-proof mechanism linking the rotary drive shaft to the linearly slidable interrupter rod.

SUMMARY OF THE INVENTION

The instant invention is an actuator used in combination with a load switch having a rotary drive shaft extending along a drive axis and carrying a cam and with an interrupter having an operating rod displaceable longitudinally of itself and generally perpendicular to the drive axis. The inventive actuator has a frame fixed adjacent the shaft and interrupter and defining upper and lower pivots having respective upper and lower axes spaced from each other and generally parallel to the drive axis. An output parallelogrammatic linkage has an output link having upper and lower ends, movable between an upper and a lower position, and formed with an aperture alignable axially with the input-link aperture, an upper lever having an inner end pivoted on the upper pivot and an outer end pivoted on the output link at the upper end thereof, a lower lever having an inner end pivoted on the lower pivot and an outer end pivoted on the output link at the lower end thereof, and an output coupling formation connected longitudinally on the rod so that on movement between the upper and lower positions the interrupter is operated. An input parallelogrammatic linkage has an input link formed with an aperture, having upper and lower ends and movable between respective upper, an upper lever having an inner end pivoted on the upper pivot and an outer end pivoted on the input link at the upper end thereof, a lower lever having an inner end pivoted on the lower pivot and an outer end pivoted on the link at the lower end thereof, and an input coupling formation bearing radially on the cam so that rotation of the cam vertically displaces the input link between its upper and lower positions. A spring braced vertically in the windows in a position with the windows aligned axially bears upward on all the upper links and downward on all the lower links. Respective upper and lower stops on the frame engageable with the output link in respective upper and lower positions arrest same therein. Respective upper and lower release formations on the input linkage engage the stops on displacement of the input link into the respective upper and lower positions to release the output link from them.

Thus with this system the main actuating elements, the input and output links, can be formed of cheaply produced stamped plates that can be produced at very low cost to very high tolerances. High tolerances can be achieved with no material-removing machining. Furthermore the parallelogrammatic linkages ensure that any friction will be confined to the bearings at the four pivot points of each linkage, and bearings or journals at these locations can easily take the strain. There is no significant horizontal movement of the output link relative to the actuator rod for minimum wear.

According to another feature of the invention the input link is formed by a pair of identical link plates axially flanking the output link. The stops are upper and lower pawls and the output link is formed with upper and lower shoulders against which the respective pawls can engage downwardly and upwardly. Similarly the input link is formed with upper and lower angled ramps engageable with the pawls and forming the release formations.

In accordance with further features of the invention upper and lower spring plates are engaged between upper and lower ends of the spring and lower and upper edges of the windows. The output link is formed by a pack of fastened-together output plates. Furthermore the input coupling formation is a roller carried on one of the input levers and bearing radially on the cam and the output coupling formation is an actuator nose formed on the output link.

BRIEF DESCRIPTION OF THE DRAWINGS

The above and other objects, features, and advantages will become more readily apparent from the following, reference being made to the accompanying drawing in which.

SPECIFIC DESCRIPTION

Figure 1:
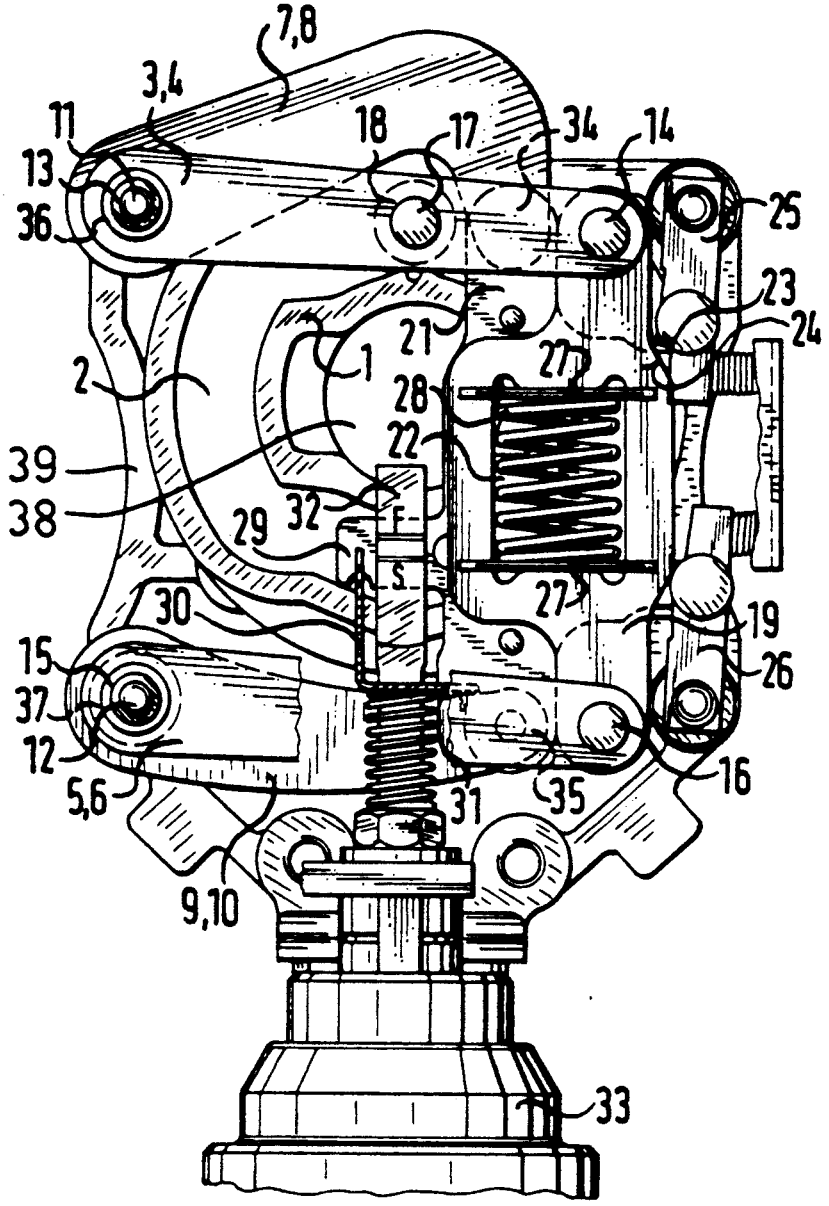
FIG. 1 is a side view of the actuator according to the invention along with parts of the switch drive shaft and the vacuum interrupter, it interconnects.
Figure 2A:
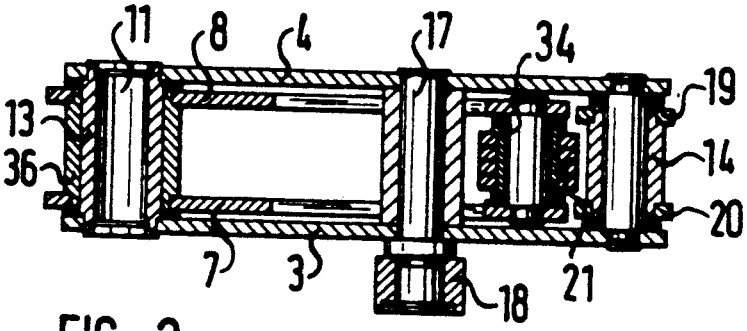
FIG. 2*a* is a section taken along line IIa—IIa of FIG. 2*b;*
Figure 2B:
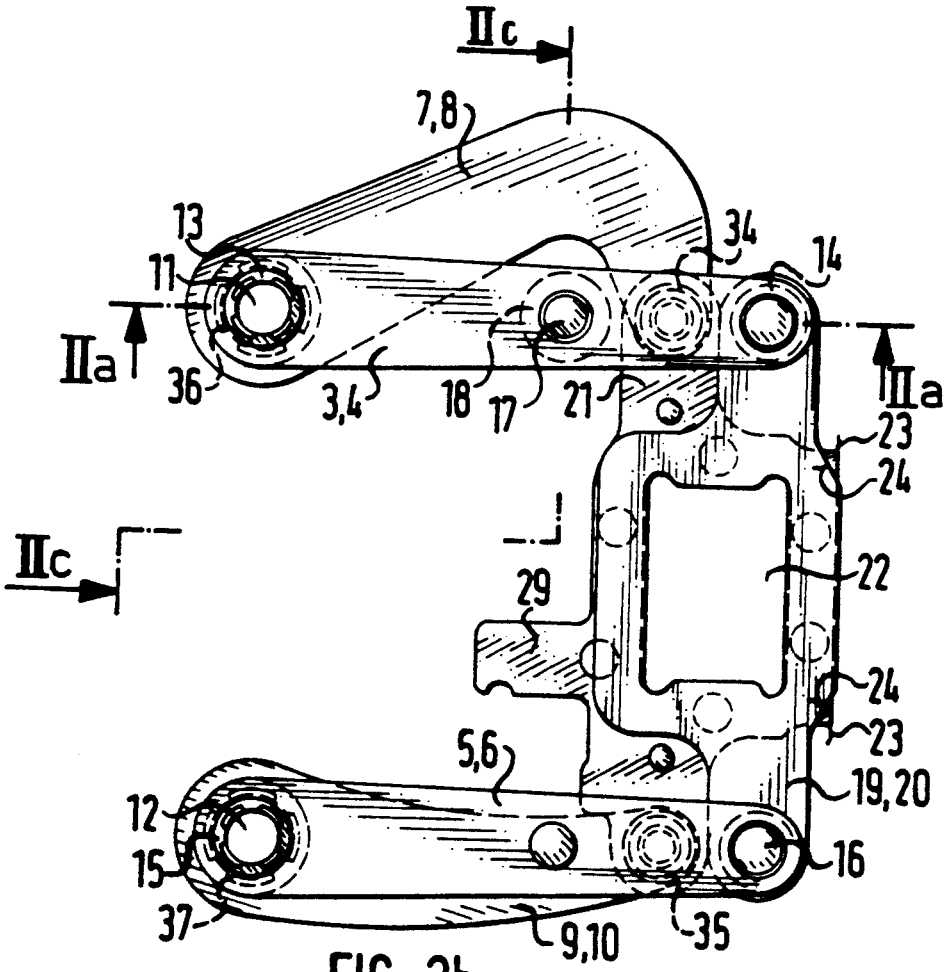
FIG. 2*b* is a side view of the mechanism of the actuator.
Figure 2C:
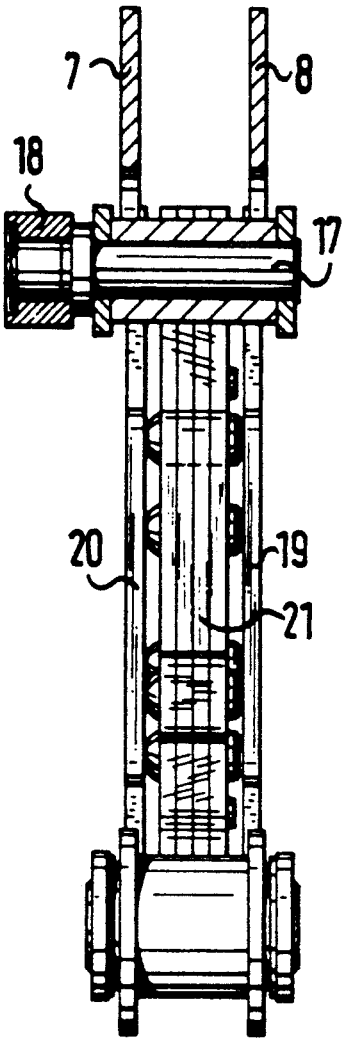
FIG. 2*c* is a section taken along line IIc—IIc of FIG. 2*b;*
Figure 3:
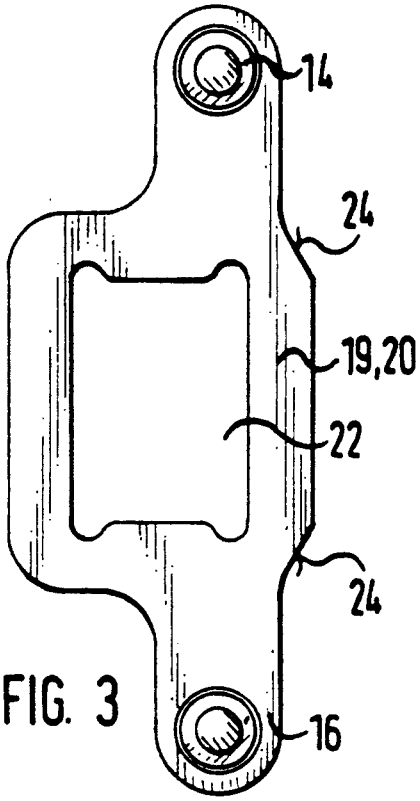
FIG. 3 is a side view of an input plate according to the invention.
Figure 4:
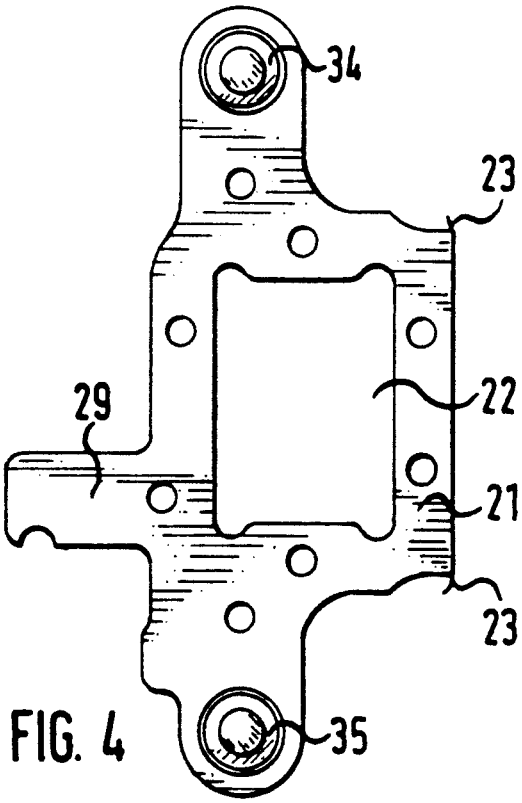
FIG. 4 is a side view of an output plate.

As seen in FIG. 1 a switch drive shaft 38 carries a cam 1 formed with a peripheral groove 2 and rotatable about a normally horizontal axis in an actuator housing or frame 39. A pair of identical input levers 3 and 4 have inner ends separated by a bushing or spacer sleeve 36 pivoted on an upper pivot 11 fixed on the frame and are interconnected offset from this pivot 11 by a rod 17 carrying a roller 18 that rides in the groove 2 on the cam 1. The outer ends of the levers 3 and 4 are fastened together and separated by a bushing 14. Directly beneath the upper levers 3, 4 are lower levers 5 and 6 that have inner ends separated by a bush or sleeve 37 riding on a pivot 12 also carried on the frame 39 directly underneath the pivot 11. The outer ends of the levers 5 and 6 are fastened together and separated by a bushing 16.

Two axially spaced input plates 19 and 20 have upper ends pivoted at the ends of the upper bushing 14 and lower ends pivoted at the ends of the bushings 16 to form with the upper lever assembly 3, 4 and the lower lever assembly 5, 6 a parallelogrammatic linkage. The lever assembly 3, 4 is of the same effective length as the assembly 5, 6 so that the plates 19 and 20 can move up and down without changing orientation relative to the vertical. The plates 19 and 20 are formed with identical axially throughgoing apertures or windows 22 and with release or tripping ramps 24 whose function will be described below.

C-shaped upper output levers 7 and 8 have inner ends separated by a bushing 13 within the bushing 36 so they are pivoted on the pivot 11 and outer ends lying somewhat within the outer ends of the levers 3 and 4 and both fastened together and separated by a bushing 34. The levers 7 and 8 are not straight so they do not interfere with the roller 18 and its mounting rod 17 and lie between the levers 3 and 4. Similarly lower output levers 9 and 10 between the levers 5 and 6 have inner ends separated by a bushing 15 riding in the bushing 37. A pack of four fastened together identical output plates 21 have their upper ends pivoted on the bushing 34 and their lower ends on the bushing 35 to form with the upper output lever assembly 7, 8 and with the lower output lever assembly 9, 10 a parallelogrammatic linkage. Once again the lever assembly 7, 8 is of the same effective length as the assembly 9, 10 so that the plates 11 can move up and down without changing orientation relative to the vertical. The plates 21 are formed with apertures 22 identical to those of the plates 19 and 20 and, in fact, perfectly alignable therewith. These plates 21 have catch or stop formations 23 whose function will be described below.

A vertical spring 28 has an upper end braced on a plate 27 riding on the upper edges of the apertures 22 and a lower end bearing downward on a plate 27 in turn bearing on the lower edges of the apertures 22. Thus this spring 28 tends to keep the apertures 22 in perfectly alignment with each other.

An upper spring-loaded pawl or dog 25 and a lower spring-loaded pawl or dog 26 can be engaged by the surfaces 23 and 24 to retain the plates 21 against vertical movement in either of two upper and lower positions of which the latter is seen in FIG. 1. The release or tripping ramps can push the latching pawls 25 and 26 off the edges 23 and thereby free the plates 21 for vertical movement.

The plates 21 are each formed with a laterally projecting actuating formation or nose 29 that bears on an angle plate 30 that in turn bears via a spring 31 on an actuating rod 32 of a vacuum interrupter 33. For a normal switching operation this rod 32 must be pushed forcibly and suddenly downward to open a circuit and then pushed forcibly and suddenly upward to close it again, or vice versa.

This mechanism functions as follows:

Presuming that the upper dogs 25 are engaged on the upper stop formations 23 and the plates 19, 20, and 21 are all held in the FIG. 1 lower position, rotation of the shaft 38 will force the cam 1 under the roller 18 to push up the input levers 3–6 and simultaneously raise the plates 19 and 20. This will pull the lower edges of the windows 22 of the plates 19 and 20 above the lower edges of the windows 22 of the plates 21, thereby compressing the spring 28.

Once the plates 19 and 20 reach an upper position above the illustrated lower position, the upper release ramps 24 engage the upper dog 25 and push it back, thereby releasing the plates 21. The force of the spring 28 will snap up the plates 21, causing the actuating formation 20 to snap up and operate the vacuum interrupter. Once the plates 21 reach the upper position, the dogs 26 will latch in place under them and retain them in this position.

Further rotation of the shaft 38 will similarly push down the plates 19 and 20 to load the spring 28 and, once they return to the lower position, release the lower dogs 26 to allow the plates 21 to snap down and push down the rod 32, thereby open-circuiting the interrupter 33.

We claim:

1. In combination with a load switch having:

a rotary drive shaft extending along a drive axis and carrying a cam, and an interrupter having an operating rod displaceable longitudinally of itself and generally perpendicular to the drive axis, an actuator comprising:

a frame fixed adjacent the shaft and interrupter and defining upper and lower pivots having respective upper and lower axes spaced from each other and generally parallel to the drive axis;

an output parallelogrammatic linkage having an output link having upper and lower ends, movable between an upper and a lower position, and formed with a window, an upper lever having an inner end pivoted on the upper pivot and an outer end pivoted on the output link at the upper end thereof, a lower lever having an inner end pivoted on the lower pivot and an outer end pivoted on the output link at the lower end thereof, and an output coupling formation connected longitudinally on the rod, whereby on movement between the upper and lower positions the interrupter is operated, an input parallelogrammatic linkage having an input link formed with an window alignable with the output-linkage window, having upper and lower ends, and movable between respective upper and lower positions, an upper lever having an inner end pivoted on the upper pivot and an outer end pivoted on the input link at the upper end thereof, a lower lever having an inner end pivoted on the lower pivot and an outer end pivoted on the link at the lower end thereof, and an input coupling formation bearing radially on the cam, whereby rotation of the cam vertically displaces the input link between its upper and lower positions;

a spring braced vertically in the windows and, in a position with the windows aligned axially, bearing upward on all the upper links and downward on all the lower links;

respective upper and lower stop means on the frame engageable with the output link in respective upper and lower positions to arrest same therein; and respective upper and lower release formations on the input linkage engageable with the stop means on displacement of the input link into the respective upper and lower positions to release the respective stop means from the output linkage.

2. The load-switch actuator defined in claim 1 wherein the input link is formed by a pair of identical link plates axially flanking the output link.

3. The load-switch actuator defined in claim 1 wherein the stop means are upper and lower pawls and the output link is formed with upper and lower shoulders against which the respective pawls can engage downwardly and upwardly.

4. The load-switch actuator defined in claim 3 wherein the input link is formed with upper and lower angled ramps engageable with the pawls and forming the release formations.

5. The load-switch actuator defined in claim 1, further comprising upper and lower spring plates engaged between upper and lower ends of the spring and lower and upper edges of the windows.

6. The load-switch actuator defined in claim 1 wherein the output link is formed by a pack of fastened-together output plates.

7. The load-switch actuator defined in claim 1 wherein the input coupling formation is a roller carried on one of the input levers and bearing radially on the cam.

8. The load-switch actuator defined in claim 1 wherein the output coupling formation is an actuator nose formed on the output link.

9. The load-switch actuator defined in claim 1 wherein the interrupter is a vacuum interrupter.

10. In combination with a load switch having:

a rotary drive shaft extending along a drive axis and carrying a cam, and a vacuum interrupter having an operating rod displaceable longitudinally of itself and generally perpendicular to the drive axis, an actuator comprising:

a frame fixed adjacent the shaft and interrupter and defining upper and lower pivots having respective upper and lower axes spaced from each other and generally parallel to the drive axis;

an output parallelogrammatic linkage having an output link having upper and lower ends, movable between an upper and a lower position, and formed with an axially throughgoing aperture, an upper lever having an inner end pivoted on the upper pivot and an outer end pivoted on the output link at the upper end thereof, a lower lever having an inner end pivoted on the lower pivot and an outer end pivoted on the output link at the lower end thereof, and an output coupling formation projecting transversely from the link and connected longitudinally to the rod, whereby on movement between the upper and lower positions the interrupter is operated, an input parallelogrammatic linkage having an input link formed with an axially throughgoing window alignable with and identical to the output-link window, having upper and lower ends, and movable between respective upper and lower positions, a pair of upper levers flanking the output-linkage upper lever and each having an inner end pivoted on the upper pivot and an outer end pivoted on the input link at the upper end thereof, a pair of lower levers flanking the output-linkage lower lever and each having an inner end pivoted on the lower pivot and an outer end pivoted on the link at the lower end thereof, and an input coupling formation bearing radially on the cam, whereby rotation of the cam vertically displaces the input link between its upper and lower positions;

a spring braced vertically in the windows and, in a position with the windows aligned axially, bearing upward on all the upper links and downward on all the lower links;

respective upper and lower stop means on the frame engageable with the output link in respective upper and lower positions for arresting same therein; and respective upper and lower release formations on the input linkage engageable with the stop means on displacement of the input link into the respective upper and lower positions to release the respective stop mean from the output linkage.

* * * * *